US007752707B2

(12) United States Patent
Mayes et al.

(10) Patent No.: US 7,752,707 B2
(45) **Date of Patent: *Jul. 13, 2010**

(54) BAG CAGE HAVING BAG CANDY

(75) Inventors: R. Michael Mayes, Lancaster, KY (US); Ronald E. Davis, Lancaster, KY (US); Kerry L. Dever, Lexington, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 94 days.

This patent is subject to a terminal disclaimer.

(21) Appl. No.: 11/453,706

(22) Filed: Jun. 15, 2006

(65) Prior Publication Data

US 2007/0289088 A1 Dec. 20, 2007

(51) Int. Cl.
*A47L 9/10* (2006.01)

(52) U.S. Cl. ..... 15/347; 15/412; 15/413; 55/366; 55/379; 55/495; 55/DIG. 1; 55/DIG. 2

(58) Field of Classification Search ..... 15/350–352, 15/339, 347, 412, 413, 327.2; 55/366, 379, 55/495, DIG. 1, DIG. 2; *A47L 9/10, 9/20*
See application file for complete search history.

(56) References Cited

U.S. PATENT DOCUMENTS

| | | | | |
|---|---|---|---|---|
| 2,210,953 A | | 8/1940 | Replogle | |
| 2,269,482 A | | 1/1942 | Replogle | |
| 2,415,372 A | | 2/1947 | Salt et al. | |
| 3,320,727 A | * | 5/1967 | Farley et al. | 55/337 |
| 3,653,189 A | | 4/1972 | Miyake et al. | |
| 3,869,265 A | * | 3/1975 | Wolter et al. | 15/327.2 |
| 4,105,421 A | | 8/1978 | Rheinfrank, Jr. et al. | |
| 4,158,554 A | | 6/1979 | Bundy et al. | |
| 4,194,894 A | | 3/1980 | Noland | |
| 4,527,302 A | * | 7/1985 | Maurer et al. | 15/325 |
| 4,670,937 A | * | 6/1987 | Sumerau et al. | 15/329 |
| 4,705,547 A | | 11/1987 | Rotola, Jr. et al. | |
| 4,960,446 A | * | 10/1990 | Werner et al. | 55/312 |
| 5,016,316 A | | 5/1991 | McAllise et al. | |
| 5,498,272 A | | 3/1996 | Leon | |
| 5,715,566 A | | 2/1998 | Weaver et al. | |
| 5,755,009 A | * | 5/1998 | Stephens et al. | 15/347 |
| 6,085,382 A | * | 7/2000 | Bobrosky et al. | 15/350 |
| 6,151,751 A | * | 11/2000 | McCormick et al. | 15/351 |
| 6,609,270 B2 | | 8/2003 | Kim | |
| 6,615,444 B2 | * | 9/2003 | McGilll et al. | 15/352 |

(Continued)

OTHER PUBLICATIONS

Electrolux, Owner's Guide, Oxygen3 Canister Series, 2005 Electrolux Home Care Products Ltd., printed in U.S.A.

(Continued)

*Primary Examiner*—David A Redding
(74) *Attorney, Agent, or Firm*—King & Schickli, PLLC

(57) ABSTRACT

A vacuum cleaner includes a housing, a suction generator carried by the housing, a bag compartment and a bag cage. The bag compartment is defined by a bag compartment wall including an airflow inlet and an airflow outlet. The bag cage is received in the bag compartment. The bag cage defines a bag cavity that hold a filter bag in a position spaced from the bag compartment wall so as to maintain a clear airflow passage. The bag cage includes a bag caddy having a bag holder.

20 Claims, 5 Drawing Sheets

U.S. PATENT DOCUMENTS

| | | | | |
|---|---|---|---|---|
| 6,626,969 | B1 * | 9/2003 | Steele | 55/374 |
| 6,862,773 | B2 * | 3/2005 | Park et al. | 15/351 |
| 7,152,274 | B2 * | 12/2006 | Alford et al. | 15/352 |
| 2003/0145419 | A1 * | 8/2003 | Park et al. | 15/351 |
| 2007/0022565 | A1 | 2/2007 | Mayes et al. | |

OTHER PUBLICATIONS

USPTO Office Action dated Dec. 3, 2008 for U.S. Appl. No. 11/191,736, 9 pgs.

USPTO Office Action dated Jun. 22, 2009 for U.S. Appl. No. 11/191,736, 9 pgs.

USPTO Office Action dated Sep. 14, 2009 for U.S. Appl. No. 12/498,065, 7 pgs.

USPTO Notice of Allowance dated Oct. 27, 2009 for U.S. Appl. No. 11/191,736, 8 pgs.

U.S. Appl. No. 12/498,065 filed Jul. 6, 2009, 18 pgs.

* cited by examiner

BAG CAGE HAVING BAG CANDY

TECHNICAL FIELD

The present invention relates generally to the floor care equipment field and, more particularly, to a vacuum cleaner equipped with a bag cage having a bag caddy.

BACKGROUND OF THE INVENTION

A vacuum cleaner is an electrically powered, mechanical appliance utilized for the dry removal of dust and loose dirt from carpets, rugs, fabrics, bare floors and other surfaces. Vacuum cleaners have been widely utilized for years in domestic and industrial cleaning applications.

In operation, a pressure drop is utilized to force air entrained with loose dirt and dust into the nozzle of a vacuum cleaner. The dust and dirt laden air is then drawn through a bag which traps and retains the dirt. The air is then exhausted by electric fan through an additional filter to remove relatively fine particles. It is this fan that provides the air pressure drop or vacuum that provides the cleaning action.

It is only possible to maximize free airflow and thus cleaning ability by employing uniform airflow through the entire available surface area of the filter bag: that is the area above the level of accumulated dirt and debris. However, an inherent problem in the design of current bag vacuum cleaners prevents the filter bag from maximizing its full volume and, accordingly, air power (i.e. suction and air velocity) drops off rapidly with material ingestion. Specifically two primary functional flaws combine to decrease cleaning efficiency.

First, the filter bag in prior art vacuum cleaners expands with airflow to contact the surrounding vacuum or bag chamber walls. As a consequence, no air gap or passage is maintained between the filter bag and the inner chamber wall surface. This functions to seal off airflow through the entire circumferential surface area of the filter bag. With no alternative pathway available, air is then forced to flow entirely through the bottom of the bag and any accumulated material therein. This decreases the total airflow and the motor efficiency.

Second, the vacuum chamber outlet or plenum mouth is typically undersized, requiring a sharp bend in the flow path from the outer periphery of the bag bottom resulting in increased flow resistance and back pressure. When considered together these two problems have a very significant adverse effect on the cleaning efficiency of the vacuum cleaner as the filter bag is filled with material.

U.S. patent application Ser. No. 11/191,736, filed 28 Jul. 2005 and owned by the assignee of the present invention addresses and resolves both of these problems. The vacuum cleaner disclosed in that document incorporates a bag cage that advantageously affords prolonged air power with progressive ingestion of material thus maximizing the capacity of the filter bag and the cleanability of the vacuum cleaner. The present invention relates to an improvement of that basic design. Specifically, the bag cage of the present invention incorporates a bag caddy that allows the operator to more conveniently change the filter bag.

SUMMARY OF THE INVENTION

In accordance with the purposes of the present invention as described herein, a new and improved floor care appliance or vacuum cleaner is provided. The vacuum cleaner may take substantially any form including an upright vacuum cleaner, a canister vacuum cleaner or a handheld vacuum cleaner. The vacuum cleaner may be generally described as including a housing and a suction generator carried by the housing. In addition the vacuum cleaner includes a bag compartment wall defining a bag compartment in the housing. The bag compartment wall includes an airflow inlet and an airflow outlet. Still further, the vacuum cleaner includes a bag cage. The bag cage is received in the bag compartment. The bag cage defines a bag cavity. That bag cavity is spaced from the bag compartment wall so as to maintain an airflow passage or gap between the bag cavity and the bag compartment wall. The bag cage also includes a bag caddy having a bag holder. This bag caddy allows an operator to conveniently change the filter bag as necessary or desired.

More specifically describing the invention, the bag holder comprises a U-shaped channel. Further, the bag caddy includes a handle. The handle is pivotally connected to the bag caddy. In addition, the handle includes a lug or lugs that function to secure the bag caddy in position on the vacuum cleaner.

A filter bag is provided in the bag cavity. The filter bag includes an inlet connected to the airflow inlet in the bag compartment wall. More specifically, an inlet fitting projects through the bag compartment wall and defines the airflow inlet. The bag cage may be mounted to this inlet fitting. The bag compartment wall includes a front surface, a rear surface, a top surface, a bottom surface, a right side surface and a left side surface. In one possible embodiment the airflow inlet is provided in the rear surface and the airflow outlet is provided in the bottom surface.

The bag cage includes multiple openings allowing airflow from the bag cavity to the bag compartment. Typically the bag cage is greater than 50% open space for free airflow in substantially any direction.

The bag cavity has a first volume of between about 4.0 liters and about 7.5 liters and the bag compartment has a second volume of between about 5.5 liters and about 10.5 liters. The volume of the bag cavity is between about 40 and about 80 percent of the volume of the bag compartment.

The bag cage functions to hold the filter bag in a position where the filter bag is spaced from the bag compartment wall. As a consequence an airflow passage is positively maintained between the bag cage and the bottom surface of the bag compartment wall. Further, the airflow passage is maintained between the bag cage (and the filter bag maintained therein) and at least one of the right side surface, left side surface, rear surface and front surface of the bag compartment wall. In one particularly useful embodiment, the airflow passage is maintained between the bag cage (and the filter bag contained therein) and all surfaces of the bag compartment wall. Preferably the airflow passage has a cross sectional area between the bag cage and the bag compartment wall of between about 38.0 $cm^2$ and about 90.0 $cm^2$. Advantageously, the airflow passage allows free airflow that is unimpeded by the bag compartment wall from the entire surface of the bag above the level of accumulated dirt and debris within the bag to the airflow outlet leading from the bag compartment to the suction generator.

The airflow outlet has a cross sectional area of at least 13.0 $cm^2$ and typically between about 13.0 $cm^2$ and about 58.0 $cm^2$ so as to enable the suction generator to freely draw the air from the filter bag and thereby maintain good air power or suction air velocity for optimal cleaning efficiency at all times.

In the following description there is shown and described a preferred embodiment of the invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of this specification illustrates several aspects of the present invention and together with the description serves to explain certain principles of the invention. In the drawing.

Reference will now be made in detail to the present preferred embodiment of the invention, an example of which is illustrated in the accompanying drawings.

DETAILED DESCRIPTION OF THE INVENTION

Figure 1:
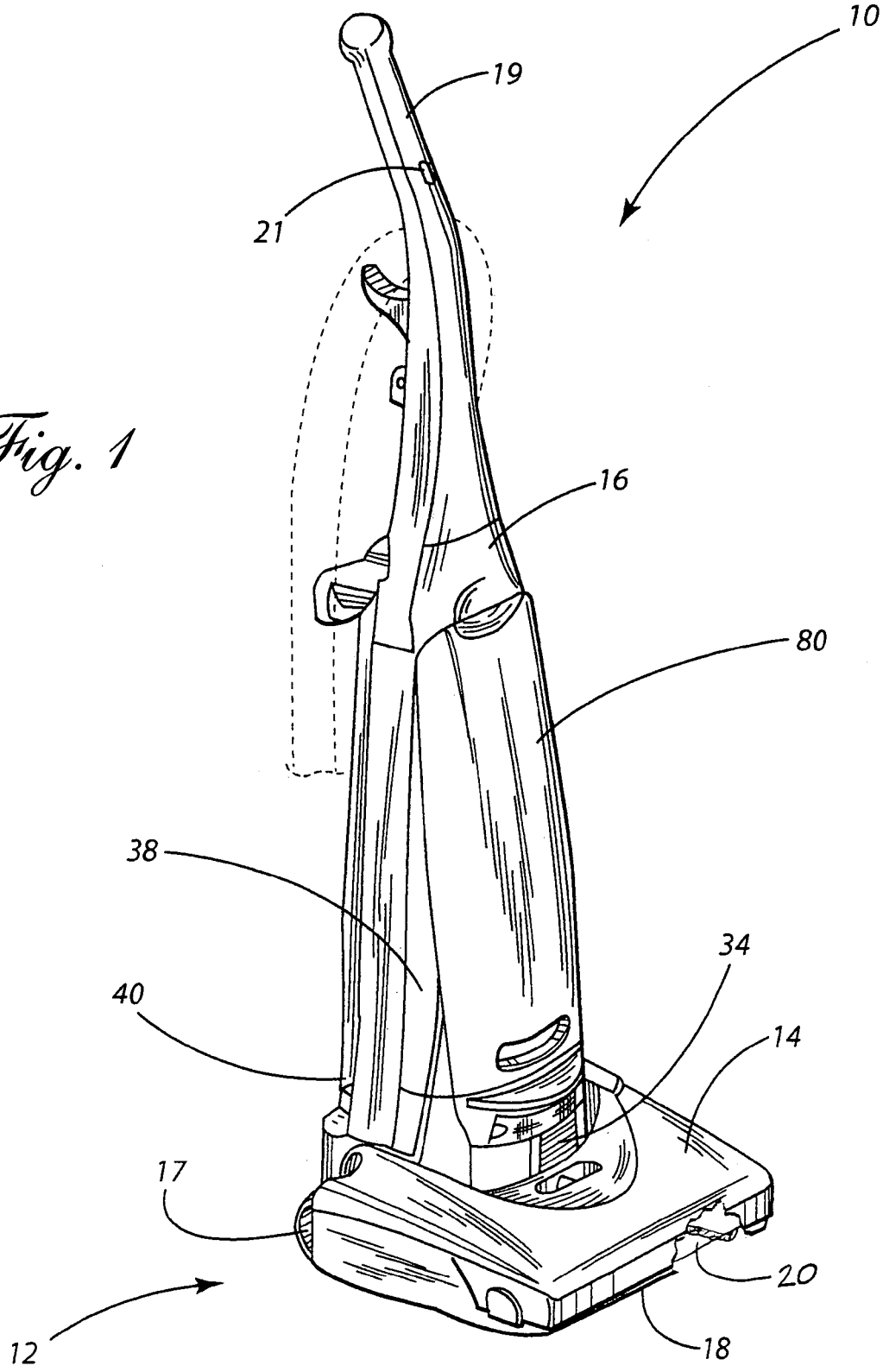
FIG. 1 is a perspective view of one possible embodiment of the vacuum cleaner of the present invention.

Reference is now made to FIG. 1 illustrating one possible embodiment of the vacuum cleaner 10 of the present invention. The illustrated embodiment is an upright vacuum cleaner 10.

The vacuum cleaner 10 includes a housing, generally designated by reference numeral 12, including a nozzle section or assembly 14 and a canister section or assembly 16. As is known in the art, the canister section 16 is pivotally connected to the nozzle section 14 to aid the operator in manipulating the vacuum cleaner 10 back and forth across the floor. Wheels 17 (only one illustrated in FIG. 1) carried on the housing 12 allow the vacuum cleaner 10 to be moved smoothly across the floor. As illustrated, the nozzle section 14 is equipped with a suction inlet 18. In the illustrated embodiment, the suction inlet 18 also includes a rotary agitator 20.

Figure 2:
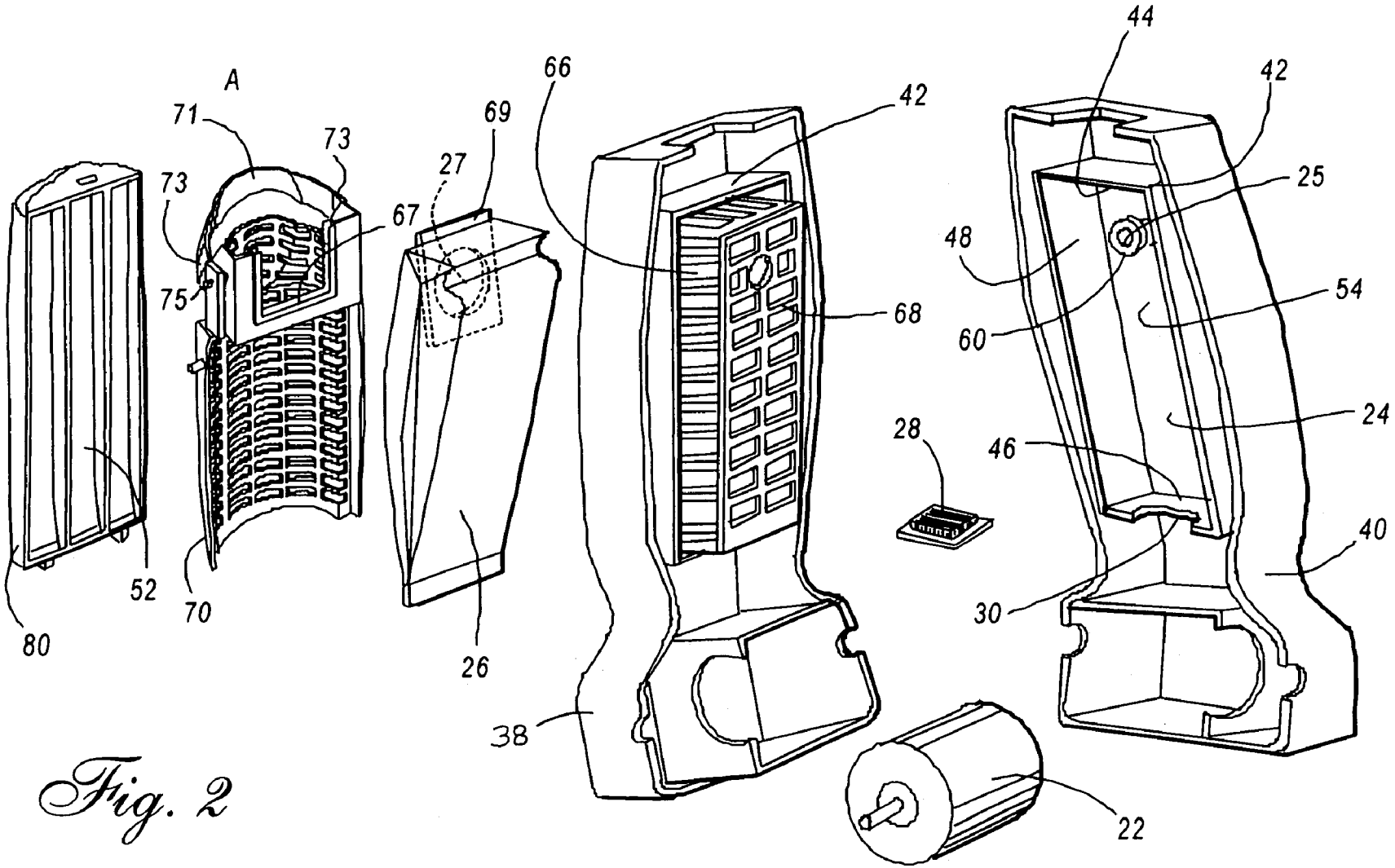
FIG. 2 is a detailed, exploded perspective view illustrating the relationship between the bag compartment, the bag cage and the filter bag.

As best illustrated in FIG. 2, the canister section 16 houses a suction generator 22 (i.e. a fan and motor assembly) and a bag compartment 24 that will be described in greater detail below. The canister section 16 also includes a control handle 19 and an actuator switch 21 for controlling the operation of the vacuum cleaner 10 and thereby driving the rotary agitator 20 and the suction generator 22 as desired. In the illustrated embodiment the actuator switch 21 comprises a series of touch controls.

During the cleaning operation the rotary agitator 20 brushes and beats dirt and debris from the nap of an underlying carpet being cleaned. The dirt and debris are then drawn by the suction generator 22 through the suction inlet 18, the airflow inlet 25, the filter bag 26 in the bag compartment 24 and the secondary filter 28 that is provided across the airflow outlet 30. Dirt and debris are collected in the filter bag 26 and fine debris is screened by the secondary filter 28. The airstream is then directed through the motor of the suction generator 22 to provide cooling before being routed through a final filter (not shown), to remove any carbon particles stripped from the brushes of the motor by the airstream, before exhausting the airstream through an exhaust port 34 into the environment.

As best illustrated in FIGS. 2 and 3, the canister section 16 includes two cooperating housing members or sections 38 and 40. The housing members 38 and 40 carry the wall 42 that defines the bag compartment 24. In the illustrated embodiment, the bag compartment wall 42 includes a top surface 44, a bottom surface 46, a right side surface 48, a left side surface 50, a front surface 52 and a rear surface 54. As illustrated, the front surface 52 may be formed by the access door 80 of the canister housing member 38 while the rear surface 54 may be formed by the housing member 40. The remaining surfaces 44, 46, 48 and 50 of the bag compartment wall 42 may be formed by cooperating segments projecting from both the housing members 38, 40 which meet and form a substantially airtight seal.

An inlet fitting 60 in the rear surface 54 of the bag compartment wall 42 defines the airflow inlet 25 into the bag compartment 24. The airflow outlet 30 is provided in the bottom surface 46 of the bag compartment wall 42. A secondary filter 28, such as a fine screen, polymeric filter media or the like, extends across the airflow outlet 30 so as to capture any fine dirt and debris that might pass through the filter bag 26 in the bag compartment 24 and thereby prevent its passage into the motor of the suction generator 22.

A bag cage, generally designated by reference numeral 64, defines a cavity 66 for receiving and holding the filter bag 26. In the illustrated embodiment, the bag cage 64 includes a first section 68, which accommodates the inlet fitting 60 and is secured to the housing section 38 or 40 by means of struts 61, and a removable bag caddy 70 (see FIG. 5). The bag caddy 70 includes a bag holder 67. In the illustrated embodiment that bag holder 67 takes the form of a U-shaped channel. The bag holder 67 receives and holds the similarly shaped cardboard bag collar 69 provided on the filter bag 26.

Figure 5:
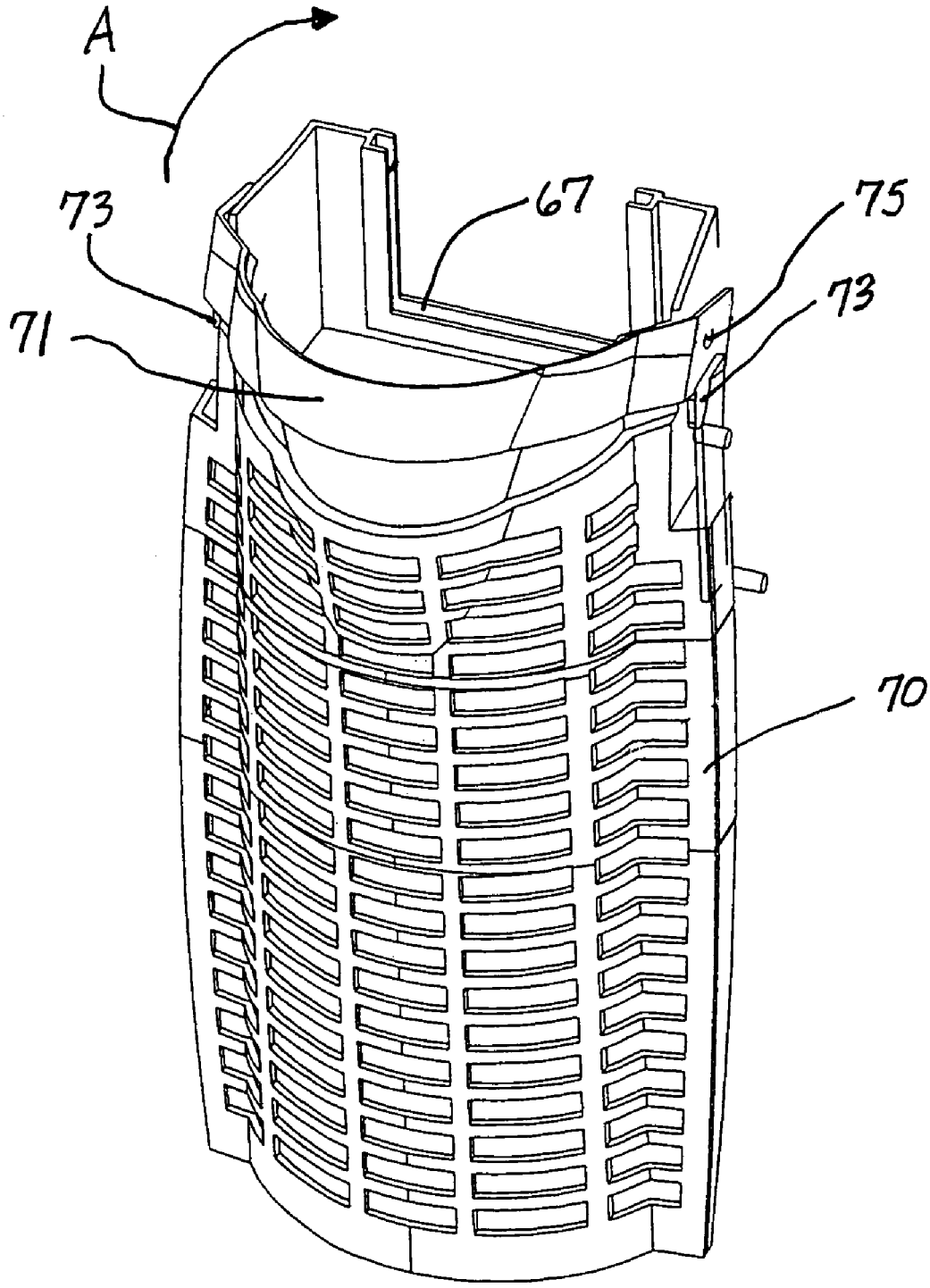
FIG. 5 is a detailed, perspective view of the bag caddy that forms a part of the bag cage.

As further shown in FIG. 5, the bag caddy 70 includes a pivotal handle 71. The pivotal handle 71 includes a pair of mounting lugs 73. The mounting lugs 73 engage cooperating structure on either the first section 68 of the bag cage 64 or the housing members 38 or 40 in order to secure the bag caddy 70 in position to close the bag cage 64.

As should be appreciated, the bag cage 64 is fully received in the bag compartment 24. The cavity 66 defined by the bag cage 64 has a first volume of between about 4.0 liters and about 7.5 liters and the bag compartment 24 has a second volume of between about 5.5 liters and about 10.5 liters. Typically, the volume of the bag cavity 66 is between about 40 and about 80 percent of the volume of the bag compartment 24.

Figure 3B:
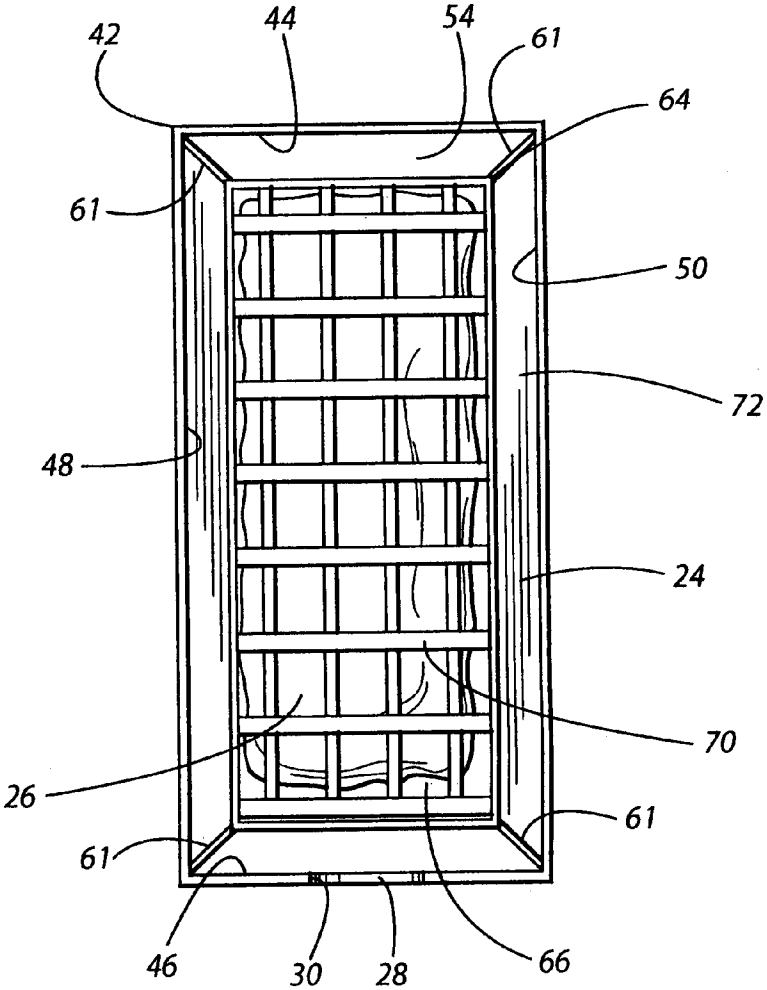
FIG. 3*b* is a detailed, longitudinal cross sectional and schematical view illustrating the airflow passage maintained between the bag cage and the right side, left side, top and bottom surfaces of the bag compartment wall.
Figure 3A:
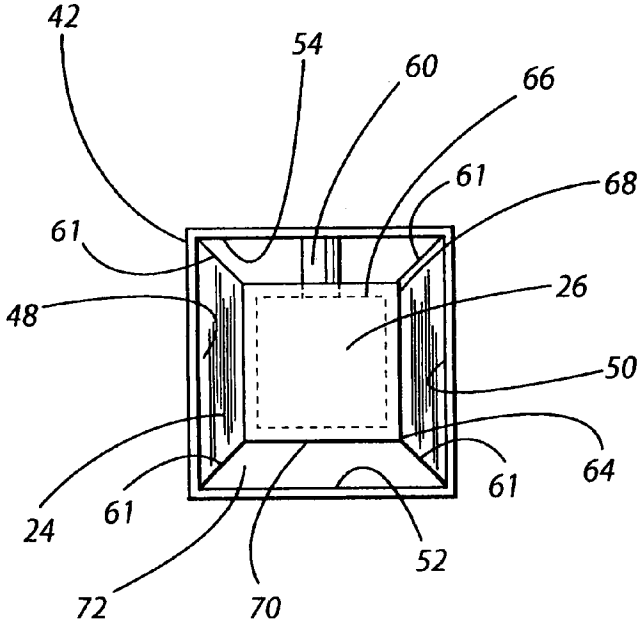
FIG. 3*a* is a detailed, transverse cross sectional and schematical view illustrating the airflow passage maintained between the bag cage, the filter bag held in the bag cage and the right side, left side, front and rear surfaces of the bag compartment wall.

As best illustrated in FIGS. 3*a* and 3*b*, the bag cage 64 is mounted in the bag compartment 24 so as to provide an airflow passage 72 completely surrounding the filter bag 26 between the bag cage 64 and the surfaces 44, 46, 48, 50, 52 and 54 of the bag compartment wall 42. Typically the air passage has a width between the bag cage 64 and the bag compartment wall 42 of between about 6.0 mm and about 32.0 mm at all points.

During vacuum cleaner operation, as air entrained with dirt and debris is drawn by the suction generator 22 from the suction inlet 18 through the airflow inlet 25 into the filter bag 26, the filter bag 26 expands and is held up against the bag cage 64. The bag cage 64 prevents the filter bag 26 from expanding into engagement with any surface 44, 46, 48, 50, 52 and 54 of the bag compartment wall 42 thereby positively maintaining the airflow passage 72 all the way around the filter bag. Advantageously, the airflow passage 72 provides a continuously free and open air path for clean air to be drawn quickly through the entire circumferential surface area of the filter bag 26 even as the filter bag fills with dirt and debris. As a consequence, the suction generator 22 is never forced to draw the majority or all of the air through the dirt and debris collecting in the bottom of the filter bag 26. As such, airflow is not significantly diminished by the collected dirt and debris and cleaning efficiency is maintained at high levels even as the filter bag 26 fills. Further, suction air velocity remains high at all times even as the filter bag 26 fills with dirt and debris.

In contrast, in bag vacuum cleaners of prior art design, the filter bag has a tendency to expand into engagement with the sidewalls of the bag compartment thereby effectively sealing and substantially preventing the free passage of air through the sidewall of the filter bag. As a consequence, the air being drawing through the vacuum cleaner by the suction generator is forced to travel through the dirt and debris in the filter bag toward the air flow outlet. The dirt and debris interferes with the free passage of the air thereby reducing the air velocity and, accordingly the cleaning power of the vacuum cleaner as the air bag fills with the dirt and debris. This problem is effectively avoided utilizing the cooperating bag cage 64 and the bag compartment 24 of the vacuum cleaner of the present invention.

It should be appreciated that the bag cage 64 is greater than 50% open space in order to promote free airflow. Further, the volume $V_1$ of the bag cavity 66, the volume $V_2$ of the bag compartment 24, the cross sectional area $A_i$ of the airflow inlet 25, the cross sectional area $A_p$ of the portion of the airflow passage 72 between the bag cage and the bag compartment wall and the cross sectional area $A_o$ of the airflow outlet are all designed to function together in order to insure clean and efficient airflow from the time the filter bag is empty to the time it is full and ready for changing.

When it becomes necessary to service the filter bag 26, the access door 80 of the canister housing member 38 is removed from the vacuum cleaner 10 so as to expose the bag caddy 70 of the bag cage 64. The bag caddy 70 is then removed from the first section 68 of the bag cage 64 so as to allow the operator access to the filter bag 26. More specifically, the handle 71 is pivoted upwardly in the direction of action arrow A about the pivot pins 75 to release the lugs 73 from the mating structure and free the bag caddy 70 for removal. The operator may then conveniently carry the dirty bag 26 by the handle 71 to a garbage can or the like. The bag collar 69 is then slipped from the bag holder 67 and the dirty bag 26 is thrown away.

Next, the bag collar 69 of a clean filter bag 26 is placed in the bag holder 67 with the filter bag extending down between the main body of the bag caddy 70 and the bag holder. The bag caddy 70 is then repositioned to mate with the first section 68 of the bag cage 64 with the bag 26 fully received in the bag cavity 66. The handle is then pivoted downwardly to bring the lugs 73 in place to lock the bag caddy 70 in position. Next the door 80 is replaced on the vacuum cleaner 10 so as to properly mate with the section 38. The vacuum cleaner 10 is then once again ready for use.

Figure 4:
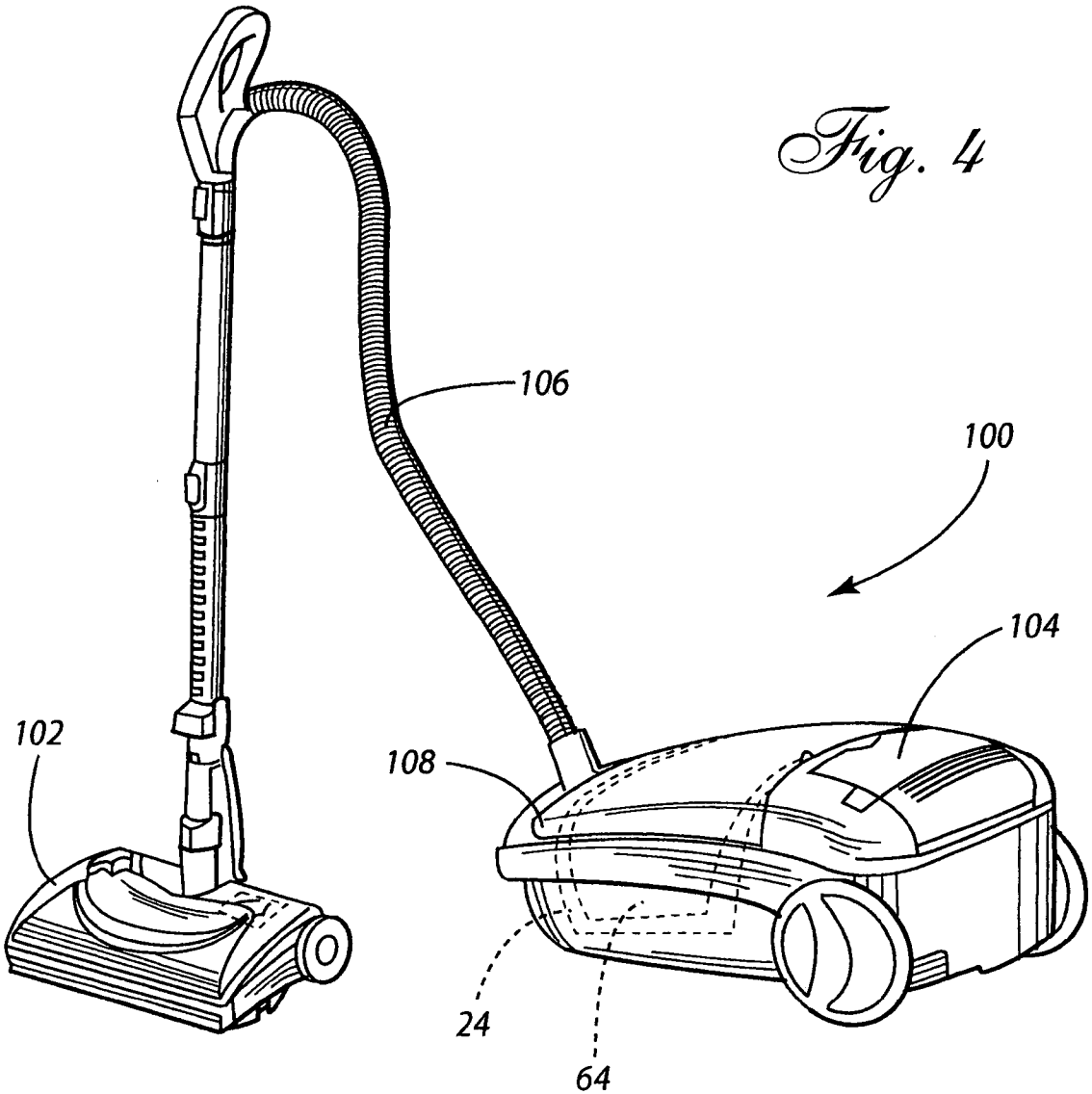
FIG. 4 is a perspective view of an alternative embodiment of the invention.

The foregoing description of a preferred embodiment of the present invention has been presented for purposes of illustration and description. It is not intended to be exhaustive or to limit the invention to the precise form disclosed. Obvious modifications or variations are possible in light of the above teachings. For example, the canister vacuum cleaner illustrated in FIG. 4 and generally designated by reference numeral 100 may be equipped with a bag compartment 24 and bag cage 64 as described above with respect to the FIG. 1 embodiment. Such a canister vacuum cleaner 100 includes a nozzle assembly 102 connected by a flexible dirty air hose 106 to a canister assembly 104. The nozzle assembly 102 may or may not be equipped with a rotary agitator. The canister assembly 104 carries the bag compartment 24 that holds the bag cage 64, and the associated suction generator. An access door 108 allows the operator to access the bag cage 64 and change the filter bag 26.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims and their fair and broad interpretation in any way.

What is claimed is:

1. A vacuum cleaner, comprising:

a housing;

a suction generator carried by said housing;

a bag compartment wall defining a bag compartment in said housing, said bag compartment wall including an airflow inlet and an airflow outlet;

a bag cage received in said bag compartment, said bag cage defining a bag cavity, said bag cavity being spaced from said bag compartment wall so as to maintain an airflow passage between said bag cavity and said bag compartment wall, said bag cage including a bag caddy having a bag holder, and a pivotally connected handle.

2. The vacuum cleaner of claim 1, wherein said bag holder comprises a U-shaped channel.

3. The vacuum cleaner of claim 1, wherein said handle includes a mounting lug.

4. The vacuum cleaner of claim 1 further including a filter bag in said bag cavity.

5. The vacuum cleaner of claim 4, wherein said filter bag includes an inlet connected to said airflow inlet.

6. The vacuum cleaner of claim 1, wherein said bag cage includes multiple openings allowing airflow from said bag cavity to said bag compartment.

7. The vacuum cleaner of claim 1, wherein said bag compartment wall includes a front surface, a rear surface, a top surface, a bottom surface, a right side surface and a left side surface.

8. The vacuum cleaner of claim 7, wherein said airflow inlet is in said rear surface and said airflow outlet is in said bottom surface.

9. The vacuum cleaner of claim 8, wherein a secondary filter is provided across said airflow outlet.

10. The vacuum cleaner of claim 7, wherein an inlet fitting projects through said bag compartment wall and defines said airflow inlet.

11. The vacuum cleaner of claim 10, wherein said bag cage is mounted to said inlet fitting.

12. The vacuum cleaner of claim 7, wherein said airflow passage is maintained between said bag cage and said bottom surface of said bag compartment wall.

13. The vacuum cleaner of claim 12, wherein said airflow passage is maintained between said bag cage and at least one of said right side surface, said left side surface, said rear surface and said front surface of said bag compartment wall.

14. The vacuum cleaner of claim 12, wherein said airflow passage is maintained between said bag cage and said right side surface, said left side surface, said front surface and said rear surface of said bag compartment wall.

15. The vacuum cleaner of claim 14, wherein said airflow passage is maintained between said bag cage and said top surface of said bag compartment wall.

16. The vacuum cleaner of claim 15, wherein said airflow passage has a cross sectional area between said bag cage and said bag compartment wall of between about 38.0 $cm^2$ and about 90.0 $cm^2$.

17. The vacuum cleaner of claim 1, wherein said bag cavity has a first volume and said bag compartment has a second volume wherein said first volume is between about 40 and about 80 percent of said second volume.

18. The vacuum cleaner of claim 1, wherein said bag cavity has a first volume of between about 4.0 liters and about 7.5 liters and said bag compartment has a second volume of between about 5.5 liters and about 10.5 liters.

19. The vacuum cleaner of claim 18, wherein said airflow inlet has a cross sectional area of between about 4.5 $cm^2$ and about 19.0 $cm^2$ and said airflow outlet has a cross sectional area of between about 13.0 $cm^2$ and about 58.0 $cm^2$.

20. The vacuum cleaner of claim 1, wherein said bag cage is greater than 50% open space for free airflow.

* * * * *

UNITED STATES PATENT AND TRADEMARK OFFICE

CERTIFICATE OF CORRECTION

PATENT NO. : 7,752,707 B2
APPLICATION NO. : 11/453706
DATED : July 13, 2010
INVENTOR(S) : R. Michael Mayes et al.

It is certified that error appears in the above-identified patent and that said Letters Patent is hereby corrected as shown below:

In the title please replace "CANDY" with --CADDY--.

Signed and Sealed this

Second Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,752,707 B2
APPLICATION NO. : 11/453706
DATED : July 13, 2010
INVENTOR(S) : R. Michael Mayes et al.

It is certified that error appears in the above-identified patent and that said Letters Patent is hereby corrected as shown below:

Title page, Item (54) and at Column 1, line 1,

In the title please replace "CANDY" with --CADDY--.

This certificate supersedes the Certificate of Correction issued November 2, 2010.

Signed and Sealed this

Seventh Day of December, 2010

David J. Kappos

David J. Kappos
*Director of the United States Patent and Trademark Office*